US006023110A

United States Patent [19]

Henrion et al.

[11] Patent Number: 6,023,110

[45] Date of Patent: Feb. 8, 2000

[54] SWITCHING EQUIPMENT

[75] Inventors: Claude Henrion, Saint Priest, France; Gunnar Johansson, Västerås; Paul Stephansson, Enebyberg, both of Sweden; Harald Vefling, Eiksmarka, Norway

[73] Assignee: ABB Research Ltd., Vasteras, Sweden

[21] Appl. No.: 08/952,933

[22] PCT Filed: Jun. 12, 1996

[86] PCT No.: PCT/SE96/00762

§ 371 Date: Mar. 2, 1998

§ 102(e) Date: Mar. 2, 1998

[87] PCT Pub. No.: WO96/42098

PCT Pub. Date: Dec. 27, 1996

[30] Foreign Application Priority Data

Jun. 12, 1995 [SE] Sweden ..... 9502123

[51] Int. Cl.[7] ..... H01H 73/12

[52] U.S. Cl. ..... 307/125; 324/422; 340/644

[58] Field of Search ..... 307/112, 116, 307/125, 130, 131; 324/415–424; 340/638, 644

[56] References Cited

U.S. PATENT DOCUMENTS

| | | | |
|---|---|---|---|
| 5,204,633 | 4/1993 | Ahladas et al. | 324/654 |
| 5,243,291 | 9/1993 | Umemura | 324/418 |
| 5,455,733 | 10/1995 | Waggamon | 361/115 |
| 5,774,323 | 6/1998 | Innes et al. | 361/187 |

*Primary Examiner*—Albert W. Paladini
*Attorney, Agent, or Firm*—Pollock, Vande Sande & Amernick

[57] ABSTRACT

Switching equipment with a contactor (CE) and a circuit breaker (BR) located ahead of the contactor. For detection of welded-together contacts of the contactor, this is provided with means (SC) adapted, a certain time after an opening order to the contactor, to apply a voltage pulse to the operating coil (12) of the contactor and to compare the current response of the operating coil with a comparison level for forming a detection signal ($s_d$), which is supplied to the circuit breaker. Upon detection of welded-together contacts, the detection signal triggers an opening of the circuit breaker for disconnection of the contactor.

7 Claims, 4 Drawing Sheets

SWITCHING EQUIPMENT

TECHNICAL FIELD

The invention relates to switching equipment with an electromagnetic contactor and a circuit breaker which is located ahead of the contactor. The contactor has an operating magnetic circuit with a magnetic core, an operating coil and an armature which moves in dependence on the current flow through the operating coil. Furthermore, the contactor has a number of contacts which are influenced by the armature.

BACKGROUND OF THE INVENTION

Electromagnetic contactors are known and have been used for a long time, for example as switching means between a voltage source and an electric motor. One problem with such contactors is that one or a few of the contact pairs of a contactor may become fixed to each other by welding, and the risk of this is greater at high currents. Such welding together of contact pairs may, for example, be caused by contact bouncing when closing the contactor towards a high making current of an electric motor.

The fact that one or more contact pairs become fixed by welding may entail serious harmful effects. Upon an opening signal to a contactor with a welded-together contact pair, the armature will move a certain distance in the opening direction, because of the resilience in the mechanical coupling, and then stop in an intermediate position. This may cause arcs in the contact pairs which are not welded together, and fire, explosion or other damage to the contactor and other equipment. In many applications, it may also, and independently thereof, cause serious consequences that a contactor does not open when, according to a supplied opening signal, it should have opened.

SUMMARY OF THE INVENTION

The object of the invention is to provide switching equipment of the kind mentioned in the introductory part of the description, in which the risk of damage and other inconvenience, which may otherwise arise during an incomplete opening of the contactor caused by welded-together contacts, is eliminated in a simple manner.

BRIEF DESCRIPTION OF THE DRAWINGS

The invention will be explained in greater detail in the following with reference to the accompanying FIGS. 1–4 wherin.

DETAILED DESCRIPTION OF THE PREFERRED EMBODIMENTS

Figure 1:
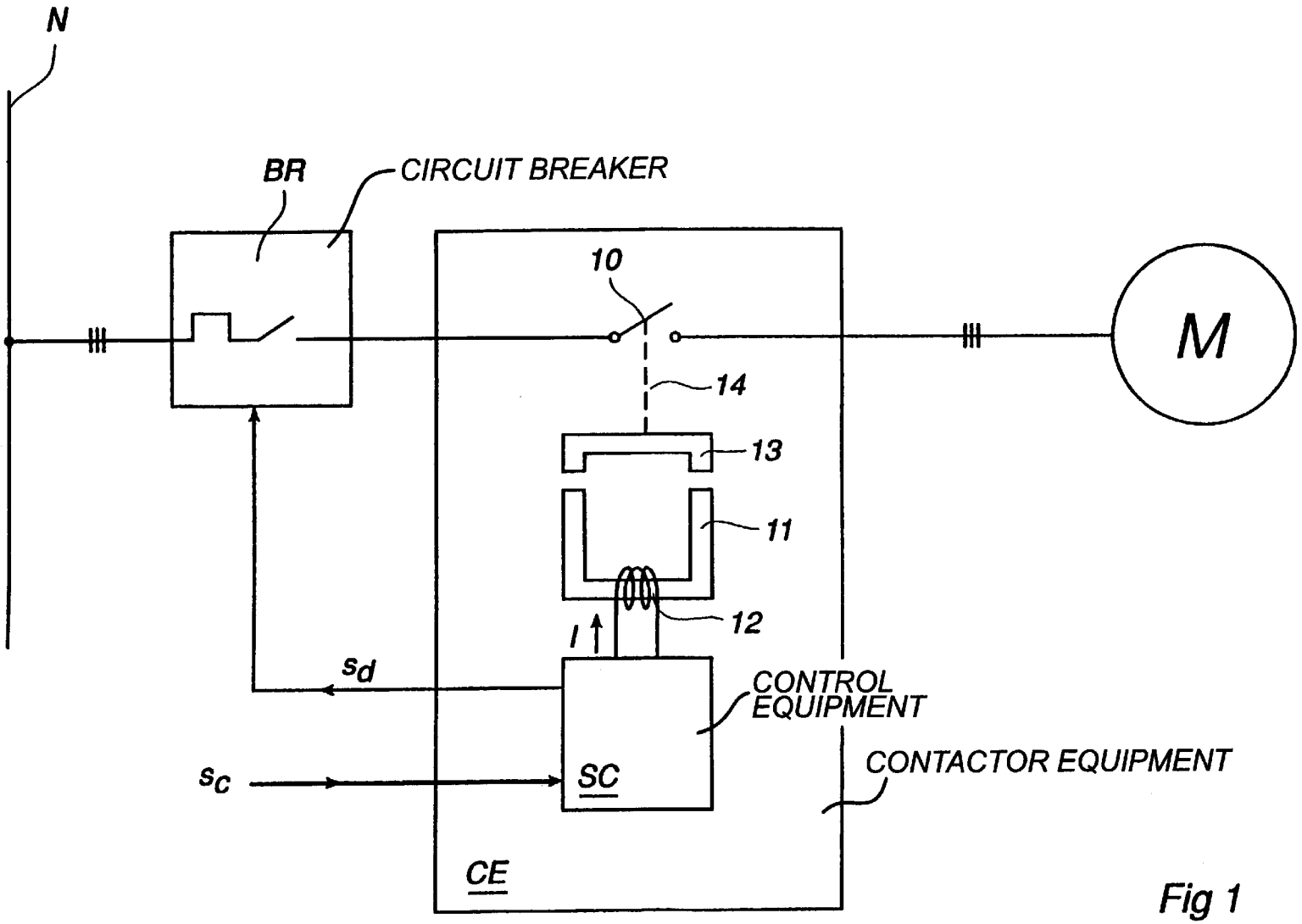
FIG. 1 shows switching equipment according to the invention, connected in the supply conduit of an ac motor.

FIG. 1 shows switching equipment according to the invention connected to the line between a three-phase motor M and an alternating-voltage power supply network N. The switching equipment comprises contactor equipment CE and a circuit breaker BR located ahead of the contact equipment (by "ahead of" is meant that the circuit breaker is arranged between the contactor equipment and the supply network.) The function of the switching equipment is to connect, in dependence on a control signal $s_c$, the motor to or disconnect the motor from the supply voltage. The control signal may be obtained in a known manner from superordinate control equipment or be supplied manually. The contactor equipment is usually adapted to also to serve as thermal overload protection means for the motor and then receives an opening signal from a current-sensing protective circuit (not shown). The circuit breaker BR, which in a known way is adapted to trip at overcurrents, serves as overcurrent protection device. As shown in the figure, the circuit breaker also receives a tripping signal $s_d$ from the contactor equipment for opening of the circuit breaker if contacts of the contactor have become fixed by welding.

In the usual manner, the contactor equipment has a bank of contacts 10 which, in the three-phase application shown, has three contacts, one for each phase. Via a resilient mechanical link 14, the contacts are mechanically connected to the armature 13 of the operating magnet 11 of the contactor, which magnet has an operating coil 12. The contactor equipment has control equipment SC which receives the control signal $s_c$. Upon signals for closing, the control equipment feeds a current I to the operating coil and maintains this current at a desired value. Further, the control circuit comprises circuits for detecting contacts which have become fixed by welding and for supplying a detection signal $s_d$ for tripping the circuit breaker BR if it is detected that contacts have become fixed by welding.

Figure 2:
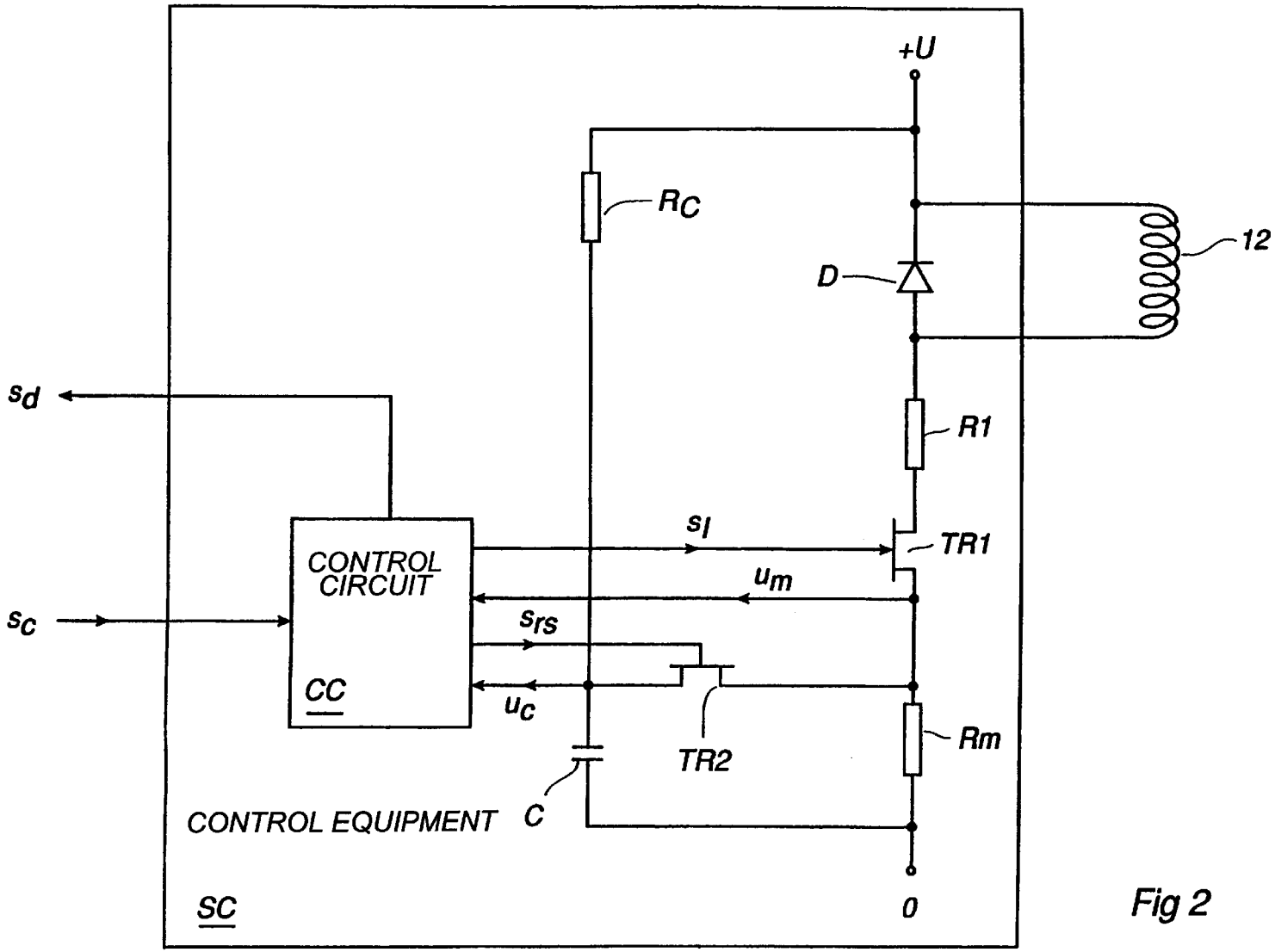
FIG. 2 shows the composition of the control equipment of the contactor.

FIG. 2 shows the composition of the control equipment SC. The operating coil 12 is connected, in series with a resistor R1, a switching transistor TR1 and a measuring resistor $R_m$, to a supply voltage source with a direct voltage +U. A bypass diode D is connected in parallel with the operating coil. A measuring voltage $u_m$, corresponding to the current I through the coil (in case of a non-conducting diode D), is obtained across the measuring resistor. The transistor TR1 is used, in the manner which will be described below, to control the current through the coil 12 upon closing of the contactor and in the closed position, as well as for applying a voltage pulse to the coil for detection of contacts being fixed by welding. An RC circuit comprising a resistor $R_C$ and a capacitor C is connected to the supply voltage source. The capacitor may be connected to the measuring resistor with the aid of a switching transistor TR2. A control circuit CC receives the control signal $s_c$ and the measurement signals $u_m$ and $u_c$, the latter corresponding to the capacitor voltage, and delivers control signals $s_I$ and $s_{rs}$ to the transistors TR1 and TR2 and the tripping signal $s_d$ to the circuit breaker BR.

Figure 3:
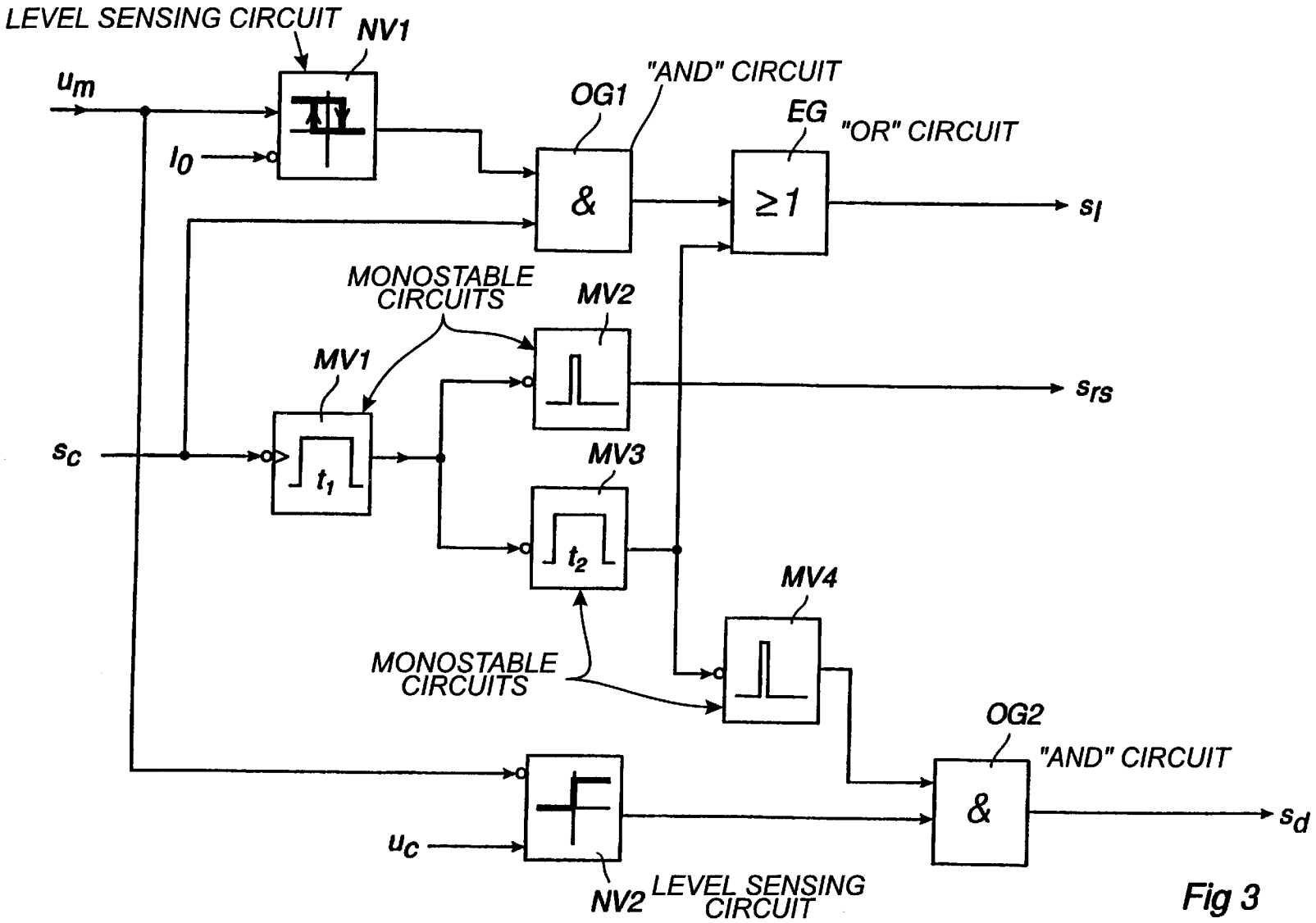
FIG. 3 shows the control circuit included in the control equipment.

FIG. 3 shows the composition of the control circuit CC. The measurement signal $u_m$ is supplied to an input of a level-sensing circuit NV1, and to the second, inverting input there is supplied a reference value $I_0$ which corresponds to the desired current through the operating coil 12 when the contactor is closed. The circuit NV1 has a certain hysteresis and delivers an output signal which becomes "0" if the coil current rises above an upper limit value and which becomes "1" if the current drops below a lower limit. The output signal of the circuit is forwarded via an AND circuit OG1 to an OR circuit EG, the output signal $s_I$ of which controls the transistor TR1, which is on at $s_I$=1 and off if $s_I$=0. The AND circuit releases the signal from NV1 and hence the control signals to the transistor if there is an order for a closed contactor, that is, if the control signal $s_c$ is "1". The circuit described so far thus controls, in a known manner, by pulsing the transistor TR1, the current through the operating coil to the desired value independently of supply voltages varying within wide limits. Circuits of this kind for control of the current through the operating coil of a contactor are known, for example from the published patent applications EP 0 136 968 A3 and WO 86/01332.

The control signal $s_c$ is also supplied to a monostable circuit MV1 which is triggered when the control signal changes from "1" to "0", that is, when an opening signal is supplied to the contactor. The circuit MV1 then delivers a pulse with a duration $t_1$ so adjusted that the contactor has normally had time to assume the open position at the end of the pulse. The output signal from the circuit MV1 is supplied to two additional monostable circuits MV2 and MV3, which are both triggered at the end of the pulse from MV1, that is, the time $t_1$ after an opening order to the contactor. The circuit MV2 delivers a short control pulse $s_{rs}$ to the transistor TR2, which thereby becomes conducting for a short moment and causes the capacitor voltage $u_c$ to become identical with the voltage $u_m$ across the measuring resistor. The circuit MV3 delivers a pulse with the duration $t_2$ which corresponds to the length of the detection interval and which, for example, may be 0.1 ms. This pulse is supplied to the transistor TR1 via the OR circuit EG and controls the transistor to a conducting state for the duration of the pulse. In this way, the supply voltage U is continuously applied to the operating coil 12 for the duration of the detection pulse. The pulse from the circuit MV3 is also supplied to a fourth monostable circuit MV4, which is triggered at the end of the pulse from MV3, that is, at the end of the detection interval, and then delivers a short signal to a second AND circuit OG2.

A level-sensing circuit NV2 is supplied with the signals $u_c$ and $u_m$, the latter with reversed sign. If $u_c>u_m$, the output signal of the circuit is "1", and when, at the end of the detection interval, the circuit OG2 receives a pulse from the circuit MV4, a signal $s_d$ is delivered which indicates whether any of the contacts of the contactor has been fixed by welding. This signal is supplied to the circuit breaker BR and triggers an immediate opening of the circuit breaker.

Figure 4:
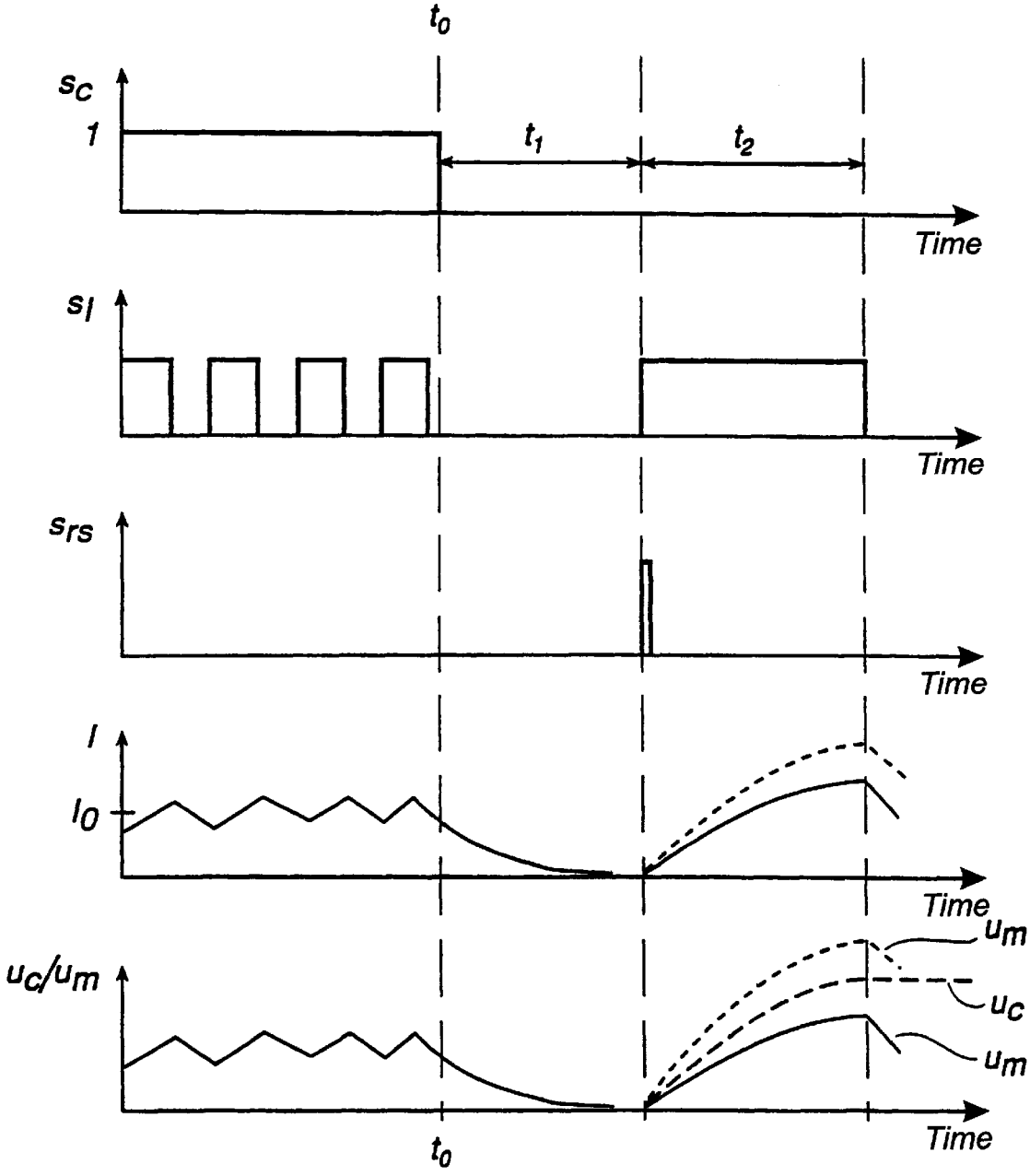
FIG. 4 shows how some of the quantities occurring in the switching equipment vary with time during an opening operation.

FIG. 4 illustrates the process of some of the quantities occurring in the switching equipment. At the top in the figure, the control signal $s_c$ is shown, which is "1" up to $t=t_0$, that is, for $t \leqq t_0$ the contactor is in the closed position. The control equipment controls the current I through the operating coil by pulsing the transistor TR1, the control signal $s_I$ of which is shown below the control signal $s_c$ in the figure. Below this, the current I is shown and as is clear from the diagram this is controlled so that its mean value corresponds to the reference value $I_0$.

At $t=t_0$ an opening order is given, and the control signal $s_c$ becomes "0". The coil current I then decreases exponentially towards zero.

After the time $t_1$ determined by the circuit MV1, the detection interval is started. A short control pulse $s_{rs}$ is supplied to the transistor TR2, which becomes conducting and causes the capacitor voltage $u_c$ to become identical with the measuring voltage $u_m$. At the same time, the transistor TR1 is controlled to the conducting state and the supply voltage U is applied to the operating coil. Its current I then increases at a rate which is dependent on the magnitude of the supply voltage and on the inductance of the operating coil (the coil resistance is assumed to be constant). The inductance, in its turn, is dependent on the reluctance (the magnetic resistance) of the magnetic circuit of the operating magnet. The reluctance varies, in turn, with the air gap between the armature and the magnetic core. It is smallest in a fully closed position, when the air gap is zero, and greatest in a fully opened position when the air gap has its greatest value. If one or more of the contacts of the contactor should be fixed by welding upon an opening operation, the armature, because of the resilient mechanical coupling between the armature and the contacts, will move a certain distance until the welded contact or contacts prevent continued movement. The armature then stops in an intermediate position, where the reluctance assumes a value between its greatest and its smallest value.

The two lowermost diagrams in FIG. 4 show how the current I and the measurement signal $u_m$ vary during the detection interval. The normal process is shown in dotted lines. The air gap has had time to assume its greatest value even at the beginning of the detection interval, the reluctance is great and the coil inductance small, and therefore the coil current increases rapidly. The unbroken lines show the process if at least one contact is fixed by welding. The reluctance then becomes lower and the coil inductance greater, and the current increases more slowly. The time constant of the RC circuit RC-C is so chosen that the signal $u_c$ increases more slowly than the coil current in the normal case but faster than the coil current in case of a contact which is fixed by welding. At the end of the detection interval, therefore, in the normal case $u_m>u_c$ and no output signal is obtained from the circuit NV2. In the case of a welded contact, on the other hand, at the end of the interval $u_m<u_c$, the output signal from the circuit NV2 becomes "1" and a tripping signal $s_d$ is delivered to the circuit breaker BR. This causes the circuit breaker to immediately trip and prevent further damage to the contactor and damage to the other equipment.

By supplying the RC circuit in the above-described embodiment from the same supply voltage source as the operating coil, the important advantage is obtained that variations in the supply voltage will influence the rate of growth of the comparison quantity $u_c$ in the same way and to the same extent as the variations influence the rate of growth of the coil current. The detection of contacts fixed by welding therefore becomes correct even if the supply voltage varies, and switching equipment according to the invention may be connected to different supply voltages without influencing the detection.

By setting the comparison quantity $u_c$, at the beginning of the detection interval, always equal to the value which corresponds to the coil current, the detection becomes correct independently of the magnitude of the coil current at the beginning of the interval. This is an important advantage and makes it possible, for example, without negatively influencing the accuracy of the detection, to initiate the detection, and when necessary achieve disconnection of the contactor, earlier than what would otherwise have been possible, thus reducing the harmful effects of contacts fixed by welding.

From experience, in a typical contactor, the reluctance in the open position is about 3–10 times greater than in the closed position, that is, the coil inductance is about 3–10 times lower. This relatively large ratio makes possible a reliable detection of contacts fixed by welding by utilizing a reluctance determination. Further, the method described above is simple and economically advantageous. It requires no transducers or extra connections of the contactor and only a relatively simple supplementation of the static parts of the contactor equipment. In the case described above, where the invention is applied to contactor equipment which is provided with means for control of the current of the operating coil, the already existing control means are utilized, and the only thing that is required is a moderate supplementation of the signal-processing circuits of the equipment.

The equipment described above is only an example, and switching equipment according to the invention can be designed in a plurality of other ways than that described above.

According to the invention, the change in the reluctance of the operating magnet, in dependence on the position of the armature, is utilized for the detection. Quantities equivalent to the reluctance may, of course, alternatively be used within the scope of the invention, for example the inverted value of the reluctance, the permeance, or the coil inductance proportional to the permeance.

In the above description, the operating coil and its current-controlling means have been used for the reluctance determination, which is a simple and advantageous embodiment, but alternatively there may be used, for example, a separate inductance measuring coil.

In the embodiment described above, a measure of the reluctance is formed by determining the current change during a time interval of a predetermined length. Alternatively, of course, a measure of the reluctance may be formed by determining the time for a predetermined current change.

The resetting of the comparison quantity (by closing the transistor TR2) described above causes the measurement to be completely independent of which value the current coil has at the beginning of the detection interval.

The invention has been described above with reference to a contactor, the contacts of which are open when the contactor is in the open position and closed in the closed position. The invention can also be applied to a contactor with at least some contact which is closed in the open position of the contactor and where thus the contactor, when this contact has been fixed by welding, may stop in an intermediate position when closing the contactor.

In the embodiment described above, the control and detection equipment is a mixture of analog and digital circuits, but the corresponding functions may be obtained in other ways, for example with the aid of an appropriately programmed microprocessor.

We claim:

1. Switching equipment with an electromagnetic contactor and a circuit breaker located ahead of the contactor, the contactor having an operating magnetic circuit with a magnetic core, an operating coil, an armature which moves in dependence on the current through the operating coil, and a number of contacts which are influenced by the armature, the switching equipment further comprising detection circuits for sensing the reluctance of the operating magnetic circuit and, in dependence on the measured reluctance, generating a signal which indicates an incomplete opening of the contactor caused by welded-together contacts, said signal being supplied to the circuit breaker so that, upon detection of welded-together contacts, the contactor is disconnected by opening of the circuit breaker, wherein the detection circuits measure the reluctance of the operating magnetic circuit by sensing the inductance of an inductance measuring coil surrounding the magnetic core, and wherein the detection circuits apply to the inductance measuring coil a voltage pulse and detect the inductance of the coil on the basis of the current response of the coil.

2. Switching equipment according to claim 1, wherein the inductance measuring coil consists of the operating coil.

3. Switching equipment according to claim 1, wherein the detection circuits sense the reluctance of the operating magnetic circuit when a time interval has elapsed after an opening order received by the contactor.

4. Switching equipment according to claim 1, wherein the detection circuits, at a predetermined time after the start of the voltage pulse, compare the current response with a reference level.

5. Switching equipment according to claim 4, wherein the detection circuits apply said voltage pulse to the inductance measuring coil by connecting the coil to a voltage source and the detection circuits comprise means for forming the reference level in dependence on the voltage of the voltage source.

6. Switching equipment according to claim 1, wherein the detection circuits, when reaching a predetermined current level, compare the time interval elapsed since the start of the voltage pulse with a predetermined time interval.

7. Switching equipment according to claim 1, wherein the operating coil is connected to a voltage source in series with a switching member for controlling the current through the coil, and the detection circuits further comprise means adapted for controlling the switching means into a conducting state for applying said voltage pulse across the operating coil.

* * * * *